US006374669B1

(12) United States Patent
Bowlin et al.

(10) Patent No.: US 6,374,669 B1
(45) Date of Patent: Apr. 23, 2002

(54) WATER INFLUX IDENTIFICATION

(75) Inventors: Kevin Rush Bowlin; Howard Lee McKinzie, both of Sugar Land; Billy Wayne Surles, Houston, all of TX (US)

(73) Assignee: Texaco Inc., White Plains, NY (US)

( * ) Notice: Subject to any disclaimer, the term of this patent is extended or adjusted under 35 U.S.C. 154(b) by 0 days.

(21) Appl. No.: 08/751,632

(22) Filed: Nov. 18, 1996

(51) Int. Cl.[7] ..... G01V 1/00; G01N 21/01

(52) U.S. Cl. ..... 73/152.18; 73/152.57; 73/152.55; 73/152.18; 356/241.1; 348/85; 166/254.2; 166/250.03

(58) Field of Search ..... 73/150.02, 152.18, 73/152.54, 152.55, 152.57; 166/250.08, 254.02; 356/241, 241.1, 82, 85

(56) References Cited

U.S. PATENT DOCUMENTS 1,889,889 A * 12/1932 Ennis ..... 166/250.98 X
2,283,429 A * 5/1942 Ennis ..... 73/152.18
2,682,800 A * 7/1954 Ennis et al. ..... 73/152.18 X
2,912,495 A * 11/1959 Moon et al. ..... 348/85
3,040,566 A * 6/1962 Sortor ..... 73/152.18
4,238,158 A * 12/1980 Sington ..... 73/152.54 X
5,140,319 A * 8/1992 Riordan ..... 348/85 X
5,440,081 A * 8/1995 Thompson ..... 348/85 X

* cited by examiner

*Primary Examiner*—Hezron Williams
*Assistant Examiner*—David J. Wiggins
(74) *Attorney, Agent, or Firm*—Morris N. Reinisch; Howrey Simon Arnold & White

(57) ABSTRACT

An improved method to detect water influx using video monitoring of a cased wellbore is disclosed. A wireline well tool having a video camera and a light source is lowered into a selected borehole interval where water influx is suspected. The borehole fluid over the selected interval is displaced and replaced with either a water transparent mixture containing a viscosifying agent, a coloring agent and/or sufficient salt to increase mixture density; or a transparent water insoluble solvent. By use of either of these displacement fluids, the quality of video monitoring over the selected borehole interval for water influx, is enhanced.

6 Claims, No Drawings

WATER INFLUX IDENTIFICATION

FIELD OF THE INVENTION

The present invention relates to formations penetrated by wells which are experiencing water influx due to casing problems, coning, channeling, fingering, or any other reservoir related cause of water influx. More particularly it relates to a method for the identification of the precise point of water influx.

It also relates to downhole video technology, to water influx identification using downhole video equipment, and to a method of replacing the clear fluid in the wellbore prior to video monitoring procedures with a fluid which is clear yet provides sufficient contrast to better facilitate the precise identification of water influx points in the well.

DESCRIPTION OF THE PRIOR ART

Oil field operators must frequently contend with the problem of excessive water influx in producing wells and of poor distribution profiles in water injection wells. Water shutoff represents an enormous expense in the oil industry. The major problem in performing water shutoff jobs is identifying the precise points of water influx.

In the production of hydrocarbons from a hydrocarbon-bearing formation there is normally provided a well which extends from the surface of the earth into the formation. The hydrocarbon-bearing portion of the formation may be overlain or underlain by a water-bearing portion of the formation.

The well may be completed by employing conventional completion practices such as running a cement casing in the well and forming perforations through the casing and cement sheaths around the casing, thereby forming an open production interval which communicates with the formation.

In the case of a hydrocarbon-bearing formation it is normally desirable to form the open production interval so that it communicates with the oil-bearing portion but does not extend into and communicate with the water-bearing portion. However, the open production interval which is formed in the well may inadvertently communicate with a water-bearing portion which is completed in the same wellbore as the hydrocarbon-bearing portion of the formation.

Even if there is no actual initial fluid communication between the open production interval and the water-bearing portions of the formation, such communication may develop during production of hydrocarbon from the hydrocarbon-bearing portion of the formation. For example, water may be drawn upwardly from the water-bearing portion into the oil-bearing portion about the well. This phenomenon is known as water coning. In the case of water coning, free water is produced in the well which results in a much higher water-to-oil ratio in the production stream than would be the case without the water coning.

A phenomenon called fingering can also occur where the viscosity of one fluid, such as water, causes the development of fingers or bulges which may be caused by points of minute heterogeneities in the reservoir. These fingers of displacing fluid tend to become extended in the direction of flow.

In situations where secondary recovery of oil is being accomplished by water flood, it is frequently found that areas of high permeability exist at points along the interior of the well into which flood water is being injected. Instead of providing the desired uniform sweep through the formation, the flood water channels through zones of high permeability, "thief zones", and finds its way to a producing well without having served any useful purpose.

Casing problems are also quite common. In the case of an oil well, for example, after the steel casing or tubing has been in place for some time, rusting and occasional shifts in the earth will cause rupturing or uncoupling of the steel casing. Water can then enter the well at these points. When this happens, visual examination is necessary to identify precise point of water influx, the extent of the break or leak, and the feasibility of repairs. Accordingly, the visual examination of the walls of a well is frequently needed when applied to the above problems.

In other instances, exploration holes are drilled to locate mineral deposits such as oil and gas, ground water, and geothermal supplies, to check the integrity for nuclear waste depositories, and also to determine the potential for landslides in an unstable environment. In any of these situations it is often possible for a crack or rupture to allow the influx of water.

Methods are known in the art for monitoring wells and for locating and analyzing fluid influxes.

In U.S. Pat. No. 4,980,642, incorporated herein by reference in its entirety, there is described a method of detection of influx of fluids invading a borehole.

U.S. Pat. No. 5,070,949, incorporated by reference in its entirety, discloses a method of controlling a well drilling operation and monitoring drilling parameters to detect a fluid influx.

Closed circuit TV camera systems are also known in the art for visually examining the walls of a given borehole. In large diameter boreholes, a trained geologist can be physically lowered into the hole with a light source to visually examine the stratification, fracturing, and layering of the various geological formations down to which the borehole penetrates. In smaller diameter holes, this type examination is impossible. Accordingly, in smaller holes visual wall examination must be made with a moving picture borehole camera or with a closed circuit television video camera. Additionally, the bore shaft itself made by the borehole is often not in a vertical orientation and has a drift or deviation in azimuth from its true vertical. There are drift recorders which monitor and log the slanting or drifting of the borehole from its true azimuth. Inclinometers are known which determine deviation as well as drift, for example, by photographing from a plumb bob position against a compass background.

U.S. Pat. No. 4,855,820 describes an apparatus and method of visually examining the sidewalls of a borehole, including a downhole video tool lowered into the borehole by means of a cable and winch on the surface. The apparatus includes a wide angle video camera enclosed in its lower section. An upper section houses, for example, a power supply/triplexer, a telemetry board, an FM modulator video amplifier transmission board, gyro data interface board and a gyroscope for showing the directional orientation of the camera and apparatus in the borehole. The gyroscope orientation and the visual image of the portion of the sidewall viewed is transmitted to a video display monitor in an equipment van on the surface. The image on the screen includes a directional reference point so that the direction of a portion of the sidewall being viewed can be ascertained. The camera images are recorded by a video cassette recorder for a permanent record of the visualization of the entire length of the borehole. Various geological data can be extrapolated by this visualization by means of the fracturing and stratification which may be observed in a given borehole. Additionally, the probe can be used to inspect boreholes previously encased by steel tubing to detect any leaks or other deterioration in the tubing system.

Positively identifying the precise source of water influx is a key step in being able to successfully treat the problem. Furthermore, for video monitoring to be successful, clear fluids must be present across and adjacent to the targeted viewing interval. This creates a problem when trying to determine the point(s) where water entry is occurring because there is no contrast in the fluids, making it almost impossible to define water flow. That is, water is entering into a water phase. When exploration personnel review video tapes of actual footage recorded downhole, the lack of contrast in fluids when looking for water entry is very evident, especially at reduced producing rates. Thus far, no practical solution to the problem is known in the art. In actual situations in the field the lack of contrast in water at the point of entry negates the value of any information obtained by downhole video cameras. Logs obtained in situations such as described cannot be accurately interpreted. Based on the attempted interpretation of such logs, the perforations could have been either producing water or completely plugged and not contributing. Without some type of indication technique to better identify the water source the success ratio of using this tool as a diagnostic is greatly reduced.

With these problems in mind, it would constitute a distinct advance in the art if there were an effective, low cost method of treating fluid used to analyze water influx which would make the precise point of water influx much easier to detect.

SUMMARY OF THE INVENTION

In accordance with the foregoing the present invention is directed to any method known in the art for identifying water entry points in a well and to the improvement comprising: Prior to the steps for locating the water influx points, replacing the wellbore fluid with a fluid selected from:

a) water to which has been added a viscosifying agent, a coloring agent and, optionally, sufficient salt to increase the density; and in the alternative, a fluid comprising b) a transparent water-insoluble solvent.

Either of these two fluids provide a distinct contrast between the injected fluid and the wellbore fluid and provide an improvement over anything presently available in the art.

In the first embodiment it has been discovered that neither the viscosifying agent nor the coloring agent alone sufficiently solves the problem, but with the two in combination it is possible to observe a distinct contrast. In the second embodiment the water-insoluble solvent enters the wellbore as small bubbles.

DETAILED DESCRIPTION OF THE INVENTION

The method of the present invention offers a cost effective solution to identifying the water entry points. It would be a valuable tool when employing downhole video services. Video monitoring of this type is discussed, for example, in U.S. Pat. No. 4,855,820, incorporated by reference herein in its entirety.

In the first embodiment of the present invention wellbore fluid is replaced prior to examination of the well with water to which a viscosifying agent, a coloring agent and, optionally, salt to increase density has been added.

The viscosifying agent can be any composition with a viscosity greater than water which would increase the internal resistance to flow of the water used to replace the wellbore fluid. It is necessary that one achieve some degree of turbulence caused by a more dense fluid mixing with a less dense fluid. Generally, suitable examples include polyacrylamides, celluloses and even starch.

In the present invention it was found that suitable viscosifying agents include hydrophilic polymers. Suitable examples include natural gums, (e.g. xanthangum) or chemically modified natural polymers, such as, for example carboxymethyl cellulose, methyl cellulose, hydroxyethyl cellulose, polyacrylamide, polyvinyl alcohol, ethylene oxide, and related compounds. Any of the hydrophilic polymers normally utilized for oil recovery operations are suitable.

In the examples herein the preferred hydrophilic polymer is hydroxyethylcellulose, a nonionic ether of cellulose which is soluble in hot or cold water, but is insoluble in organic solvents. It is stable in concentrated salt solutions and is nontoxic. The material is available commercially under several trademarks, including NATROSOL® 250 HHR. The 250 designation indicates a hydroxyethyl molar substitution of 2.5 and the HHR is an indication of the viscosity type. NATROSOL® is available from Hercules.

The amount of viscosifying agent will be in the range of 0.5 to 2% by weight, a preferred amount is 1%.

The coloring agent can be any agent which adds color. This may include any number of compounds including some organic salts. Particularly suitable coloring agents are selected from the group consisting of nitro colorants, azocolorants, triphenylmethane colorants, zanthene colorants, guinoline colorants, anthraquinone colorants, indigo color additive or pyrene color additive. Also useful are colored inorganic salts, phosphorescent dyes and related compounds. This includes a variety of red, orange, yellow, blue and green food dyes, as certified by the U.S. for coloring in foods, drugs and cosmetics. In the examples, good results were obtained using purple food-coloring dye.

Coloring agent should be added in an amount ranging from 0.1 to 2% by weight. The preferred range is 0.1 to 0.5 wt %.

The addition of inorganic salt to increase density may be indicated. Generally the most cost effective salt is NaCl. In this situation one generally would want to add sufficient salt to make the density of the wellbore fluid equal or a little greater than the density of the incoming water. The amount of salt added should be in the range of 1 to 33% by weight, preferably in the range of 20% to 30%.

In the second embodiment of the invention the wellbore fluid is replaced with a transparent water-insoluble solvent. Generally, suitable solvents are selected from the group consisting of halogenated hydrocarbon solvents, which can be aromatic, aliphatic, alicyclic, heteroyclic and combinations thereof. Suitable examples of solvent include halogenated hydrocarbons such as alkyl chloride, fluorobenzene, chlorobenzene, bromobenzene, o-dichlorobenzene and p-dichlorobenzene.

Suitable halogenated aliphatic compounds can also include halogenated alkanes and alkenes of 1 to about 8 carbon atoms, illustrated by such alkanes as carbon tetrachloride, carbon tetrabromide, bromoform, iodoform, iodoethane, 1,2-diiodoethane, 2-bromo-1-iodoethane, hexachloroethane, 1,1,1-trichloroethane, 1,1-bis (p-chlorophenyl) -2,2,2-trichloroethane, substituted 1,2-dibromoethane compounds.

The preferred solvent is bromobenzene and related water insoluble solvents.

To further illustrate the invention, the following examples are presented to illustrate the process described above, although this is supplied for the purpose of complete disclosure and is not intended to limit the scope of the invention in any way.

COMPARATIVE EXAMPLE I.

The following experiment was conducted to verify that the addition of a polymer and coloring agent would allow a downhole camera to identify water influx into the wellbore. A glass container with an inlet at the bottom was filled with water. Water was then flowed into the container and filmed with a black and white video camera from above the container, to simulate field conditions. When the video tape was played back the incoming water was not apparent. The glass container was then filled with an hydroxyethyl cellulose solution without a dye and the experiment was repeated. In this case the influx was apparent, but not striking. The glass container was then filled with purple colored hydroxyethyl cellulose solution and the experiment repeated. When the tape was played back the water influx was quite evident.

COMPARATIVE EXAMPLE II

In a well with incoming fluid of a maximum density of 1.1 g/ml, the wellbore fluid was replaced with a hydroexyethylcellulose solution and enough salt to raise the density to 1.2 g/ml. It was found that it was still difficult to determine the point of water influx.

The wellbore fluid was replaced again with coloring agent and sufficient salt to raise the density to 1.2 g/ml. The coloring agent alone was not sufficient to make apparent the point of entry of the water influx.

It has been found that neither coloration or increased viscosity alone allowed for easy identification of water entry into the wellbore. However, the combination of the two offered a definite contrast between the injected fluid and the wellbore fluid.

EXAMPLE III

In a well where incoming fluid had a maximum density of 1.1 g/ml, the wellbore fluid was replaced with a hydroxyethylcellulose solution to which a food-coloring dye and enough sodium chloride to raise the density to 1.2 g/ml had been added. Water influx could easily be seen during the logging process. After the camera was run the wellbore fluid could be produced.

EXAMPLE IV

In another example in a well to be analyzed for water influx, where incoming fluid had a maximum density of 1.1 g/ml, the wellbore fluid could be replaced with bromobenzene. When using bromobenzene in this manner the water will enter the wellbore as small bubbles in contrast to the surrounding liquid phase.

Although the invention has been described in terms of a series of specific preferred embodiments and illustrative examples which are believed to include the best mode for applying the invention known at this time, it will be recognized to those skilled in the art that various modifications may be made to the composition and methods described herein without departing from the true spirit and scope of the invention which is defined more precisely in the claims appended hereinafter below.

We claim:

1. A method for visually examining and video recording the sidewall of a selected interval of a borehole containing a wellbore fluid comprising the steps of:

attaching a closed circuit video camera at the lower end of a wellbore Measurement Tool having a sensing means for acquiring a set of logging data, said Measurement Tool being suspended into the borehole via an electrical cable and being sized and adopted for passage therethru;

attaching a light source on said tool adjacent to said video camera for illuminating a portion of the borehole being viewed by said video camera;

displacing and replacing the wellbore fluid in said selected interval of a borehole with an injected transparent water mixture having a viscosifying agent and a coloring agent acting together in combination as injected to provide optimum contrast between the injected mixture and the wellbore fluid, and optionally injecting sufficient salt to increase the mixture density during said wellbore fluid displacing and replacing step;

energizing said video camera and said light source to acquire a set of improved video images at said sidewall;

lowering said measurement tool into said borehole by means of said cable and placing said measurement tool in said selected borehole interval; and coupling a video recorder to said video camera for recording the images formed by said camera and recording the logging data measured by said measurement tool as said tool is moved across said selected interval of the borehole.

2. The method of claim 1 wherein the viscosifying agent is selected from hydroxyethyl cellulose, methyl cellulose, xanthangum and polyacrylamide.

3. The method of claim 1 wherein the viscosifying agent is present in an amount of 0.5 to 2 wt %.

4. The method of claim 1 wherein the coloring agent is selected from the group consisting of indigo colors, food dyes, colored inorganic salts, and phosphorescent dyes.

5. The method of claim 1 wherein the coloring agent is red food dye.

6. The method of claim 1 wherein the coloring agent is present in an amount of from 0.1 to 2 wt %.

* * * * *